United States Patent [19]

Otsuka et al.

[11] Patent Number: 4,565,986

[45] Date of Patent: Jan. 21, 1986

[54] ELECTROMAGNETIC CONTACTOR

[75] Inventors: Shigeharu Otsuka; Yuji Mizuno, both of Aichi; Tomoharu Hasegawa; Masahisa Kobukuro, both of Kamakura, all of Japan

[73] Assignee: Mitsubishi Denki Kabushiki Kaisha, Tokyo, Japan

[21] Appl. No.: 644,292

[22] Filed: Aug. 27, 1984

[30] Foreign Application Priority Data

Sep. 19, 1983 [JP] Japan ..... 58-172497

[51] Int. Cl.[4] ..... H01H 50/02

[52] U.S. Cl. ..... 335/131; 335/198

[58] Field of Search ..... 335/131, 132, 198

[56] References Cited

U.S. PATENT DOCUMENTS 3,099,728 7/1963 Scheib, Jr. ..... 335/131

*Primary Examiner*—Harold Broome

*Attorney, Agent, or Firm*—Sughrue, Mion, Zinn, Macpeak & Seas

[57] ABSTRACT

An electromagnetic contactor having normally open and normally closed contact pairs 22, 26 includes a movable crossbar 12 having apertures 14 with sloping guide surface 18', 18'' for guiding movable contact members 16 disposed in the apertures. These sloping surfaces serve to jam the crossbar against the base 10 of the contactor when the crossbar is moved in a direction to open fused contact pairs, to thereby prevent the normally open and normally closed contact pairs from being closed at the same time.

6 Claims, 6 Drawing Figures

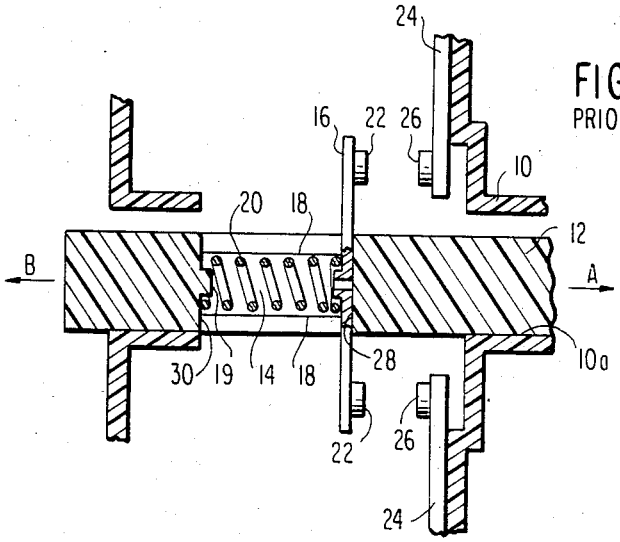
FIG. 2
PRIOR ART
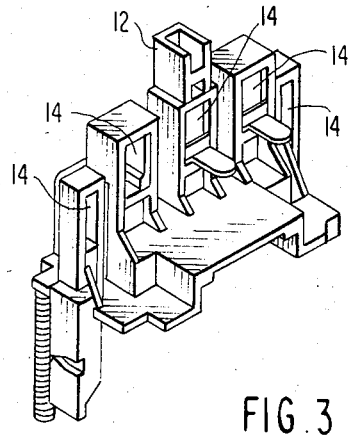
FIG. 3
PRIOR ART
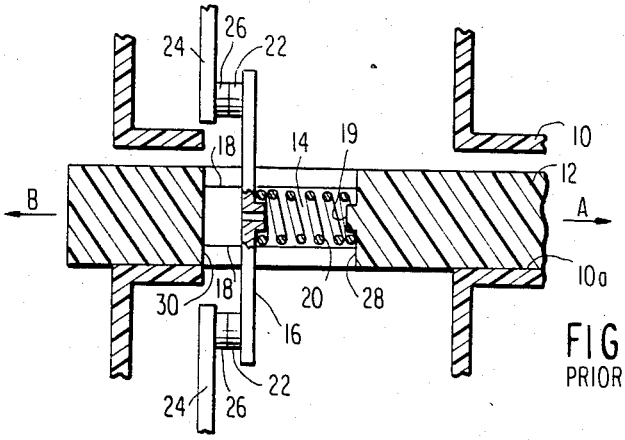
FIG. 4
PRIOR ART
FIG. 5
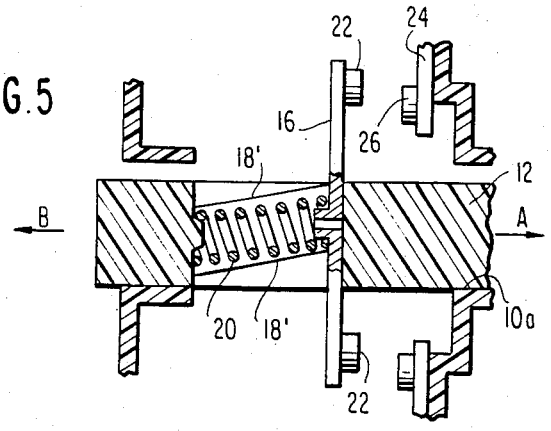
FIG. 6
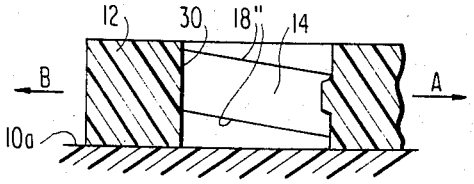

ELECTROMAGNETIC CONTACTOR

BACKGROUND OF THE INVENTION

1. Field of the Invention

The present invention relates to an electromagnetic contactor of the type having normally open and normally closed contacts.

2. Description of the Prior Art

The electrical circuits for the bidirectional motors of stamping presses, for example, are typically opened and closed by an electromagnetic contactor or relay.

FIG. 1 of the accompanying drawings shows an exploded perspective view of such a conventional electromagnetic contactor, which includes an attachment base 110 supporting a fixed iron core 114 on which a control coil 112 is mounted. A body frame 116 is screwed to the base and accommodates therein a crossbar 118 which is slidable with respect to the body frame. A movable iron core 120 is attached to the crossbar by a resilient strip 122 in confronting relation to the fixed core 114. Springs 124 are interposed between the crossbar 118 and the base 110 for normally urging the crossbar upwardly to cause the movable core 120 to be spaced upwardly from the fixed core 114.

When an exciting voltage is applied to or removed from the control coil 112, the movable core 120 is brought into or out of contact with the fixed core 114 to thereby slide the crossbar 118 upwardly or downwardly to open or close the electrical circuits of a motor, for example.

Fixed contact members 128 (only one shown) having contacts 126 are secured to the body frame 116. A movable contact member 132 is slidably disposed in an aperture 118*a* in the crossbar 118 and is biased downwardly by a holding spring 130. The movable contact member has a pair of contacts 134 on opposite ends thereof in confronting relation to the fixed contacts 126.

In response to sliding movements of the crossbar 118, the movable contacts 134 are moved into and out of contact with the fixed contacts 126 to open and close the electrical circuits.

When the fixed and movable contacts are brought into and out of contact with each other, an arc is produced between them. To prevent damage due to arc heating and the arc from flashing outwardly, an arc cover 136 is detachably mounted on the body frame 116.

FIGS. 2 through 4 schematically illustrate the contact arrangements in the prior art electromagnetic contactor. A crossbar 12 is slidably mounted in a base 10 of the electromagnetic contactor. As shown in FIG. 3, the crossbar has a plurality of apertures 14 in each of which a movable contact member 16 is slidably disposed with respect to guide surfaces 18. These guide surfaces may comprise projections or ledges outstanding from the aperture walls or depressions therein, for example, which mate with corresponding notches in or tabs on the movable contact member. Such notches or tabs are preferably extended rearwardly of the contact member to stabilize its sliding movement along the guide surfaces. A holding spring 20 is positioned in each aperture 14 with one end engaging a projecting pedestal 19 and the other end engaging a central portion of the movable contact member 16. The latter has a pair of movable contacts 22 on opposite ends thereof. Fixed contact members 24 are secured to the base 10 and have fixed contacts 26 on their distal ends confronting the respective movable contacts 22. The movable contact member 16 has slides which are slidable along the guide surfaces 18.

The movable and fixed contacts 22, 26 jointly constitute respective contact pairs in the crossbar apertures 14. The contact pairs include as many normally open contacts (FIG. 2) and as many normally closed contacts (FIG. 4) as required for the electrical circuits being controlled.

The crossbar 12 is longitudinally slidable under attractive forces from an electromagnetic means (such as the coil and cores of FIG. 1) to bring the movable and fixed contacts 22, 26 into and out of contact with each other to open and close the electrical circuits.

The distance between the movable and fixed contacts 22, 26 which they must traverse when opening and closing is shorter than the sliding movement stroke of the crossbar 12. With the normally open contact pair as shown in FIG. 2, for example, when the crossbar 12 is driven in the direction of arrow A the movable and fixed contacts 22, 26 are brought into mutual engagement. During the final portion of the sliding movement of the crossbar 12 the movable contact member 16 remains stationary due to its abutting engagement with the fixed contacts 26, and thus merely compresses the spring 20. Stated another way, as the crossbar 12 slides in the direction of arrow A, the movable contact member 16 slides in the direction of arrow B relative to the crossbar, opposite to the direction in which the crossbar is attracted, within the aperture 14, causing the contacts 22, 26 to bear against each other by the compressive force of spring 20.

Conversely, with the normally closed contact pair as shown in FIG. 4, the initial sliding movement of the crossbar 12 in the direction of arrow A merely serves to decompress the spring 20, with the contacts remaining closed, until the movable contact member 16 abuts the wall 30 at the end of the aperture 14. Thereafter the movable contact member is carried in the direction in which the crossbar 12 is attracted to thereby separate the movable and fixed contacts 22, 26 from each other.

The normally open and normally closed contact pairs are prevented from being simultaneously engaged during the sliding movement of the crossbar 12; the normally open contact pairs are closed only after the normally closed contact pairs have been opened. It is essential to prevent such simultaneous closing of the normally open and normally closed contact pairs to avoid the dangerous operation of a stamping press machine, for example. This is achieved by constructing the contactor such that the separation distance between the open contacts 22, 26 in FIG. 2 is greater than the distance between the movable contact member 16 and the aperture end wall 30 in FIG. 4.

As described above, the electrical circuits are opened and closed in response to contacting and separating movements of the normally open and normally closed contact pairs, and the guide surfaces 18 extend parallel to the longitudinal axis of the crossbar 12. If one of the contact pairs becomes fused, however, the movable contact member 16 tends to move by the decompression travel of the spring 20 and flex in the direction of sliding movement of the crossbar as the latter slides at the time the fused contacts are to be separated. With electromagnetic contactors of the type in which the distance between the open fixed and movable contact pairs is relatively short, the extent to which the movable contact member 16 moves by the decompression travel of the spring 20 and flexes may exceed the contact separation distance less the decompression travel of the spring 20. Such a condition results in the normally open and normally closed contact pairs being simultaneously closed, thus making the press device or the like being controlled more susceptible to abnormal or dangerous conditions.

SUMMARY OF THE INVENTION

With the foregoing problem in mind, it is an object of the present invention to provide an electromagnetic contactor having normally open and normally closed contact pairs which are positively prevented from being closed at the same time even when one of the contact pairs is fused.

To achieve this and other objects, each of the crossbar apertures has sloping guide surfaces against which the movable contact member slides. If no contact pairs are fused the movable contact member is cammed or driven upwardly to a slight extent during the initial spring decompression movement of the crossbar. If a contact pair is fused, however, such upward movement is prevented, and instead the crossbar is cammed or driven downwardly against its slide surface on the base. This wedging or jamming effect halts the further movement of the crossbar before any open contacts are closed, thus preventing the normally open and normally closed contacts from becoming simultaneously closed.

BRIEF DESCRIPTION OF THE DRAWINGS

FIG. 2 is a fragmentary cross-sectional view of a normally open contact arrangement in a prior art contactor as shown in FIG. 1;

FIG. 3 is a perspective view of a crossbar in the contactor of FIG. 1;

FIG. 4 is a fragmentary cross-sectional view of a normally closed contact arrangement in a prior art contactor as shown in FIG. 1;

FIG. 5 is a fragmentary cross-sectional view of a crossbar in a contactor according to the present invention, showing slanted guide surfaces in a crossbar aperture for a normally open contact pair; and FIG. 6 is a similar fragmentary cross-sectional view, in simplified schematic form, of a contactor crossbar according to the present invention, showing slanted guide surfaces in a crossbar aperture for a normally closed contact pair.

DETAILED DESCRIPTION OF THE PREFERRED EMBODIMENT

Figure 1:
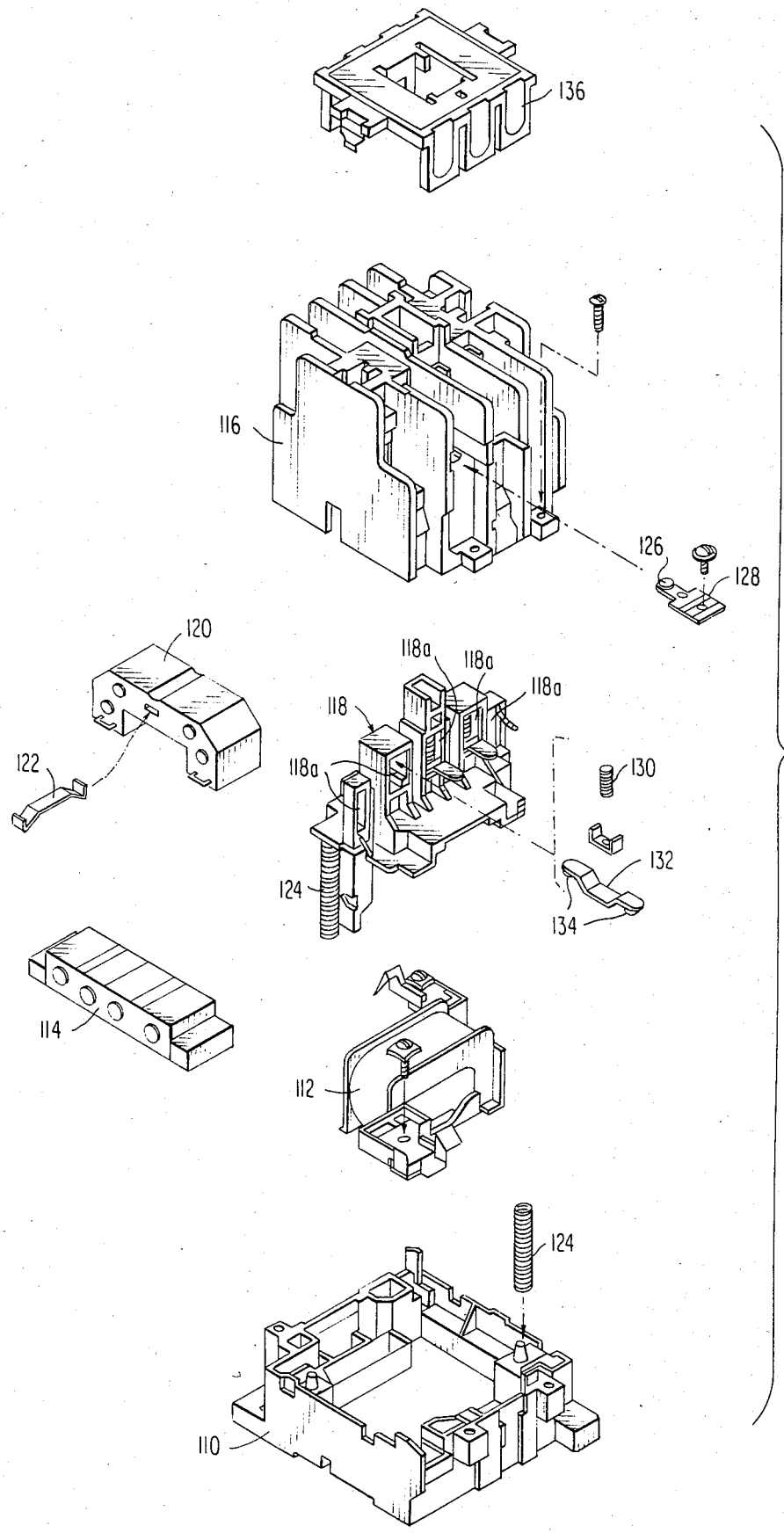
FIG. 1 PRIOR ART
FIG. 1 is an exploded perspective view of a conventional electromagnetic contactor.

FIGS. 5 and 6 show contactor crossbars according to the present invention, with FIG. 6 being only a partial schematic in the interests of simplicity. Like or corresponding parts to those shown in FIGS. 2 through 4 are denoted by the same reference characters, and will not be described in detail.

According to the invention, the guide surfaces 18' in the crossbar apertures 14 are sloped or inclined to prevent the movable contact member 16 and crossbar from undergoing sufficient sliding movement to close the contacts of the former when one of the closed contact pairs is fused, thereby stopping the sliding movement of the crossbar to reliably prevent the normally open and normally closed contact pairs from being simultaneously closed.

More specifically, as shown in FIG. 5, the guide surfaces 18' in the crossbar aperture 14 for the normally open contact pair of FIG. 2 are progressively slanted or inclined to guide or "cam" the movable contact member 16 in an upward direction away from the slide surface **10*a* of the base 10** as the crossbar is attracted in the direction of arrow B.

The condition in which the movable and fixed contacts 22, 26 of the normally open contact pair of FIG. 2 are fused together while the normally closed contact pair is being closed will first be considered. When the contacts are to be separated by moving the crossbar 12 in the direction of arrow B, the movable contact member 16 bears against the inclined guide surfaces in the crossbar aperture 14 and is guided or cammed upwardly during the initial spring decompression movement of the crossbar if none of the closed contact pairs are fused. During such upward movement the faces of the contacts 22, 26 wipe across each other to a small extent.

Since the movable and fixed contacts 22, 26 of FIG. 2 are fused together, however, the movable contact member 16 remains vertically stationary rather than being cammed upwardly, and instead the crossbar 12 is cammed or pressed downwardly against the slide surface **10*a* of the base 10. This effectively jams or wedges the crossbar against the base and prevents its further sliding in the direction of arrow B, with the consequence that the normally closed but now open contact pairs of FIG. 4** are reliably prevented from being closed.

As illustrated in FIG. 6, the guide surfaces 18'' in the crossbar aperture 14 for the normally closed contact pair of FIG. 4 include slanted surfaces which are progressively inclined in a direction opposite to those in FIG. 5.

When the normally closed contact pairs of FIG. 4 are fused together, any movement of the crossbar 12 in the direction of arrow A similarly wedges the crossbar against the base 10 as described above to prevent it from moving a sufficient distance to close the open contacts of FIG. 2. The angle of inclination of the surfaces 18', 18'' in FIGS. 5 and 6 is selected to insure the jamming or wedging of the crossbar against the base exclusively during the spring decompression travel—well before the contact separation distance is traversed.

The jamming of the crossbar also jams the movable contact member 16 against the inclined guide surfaces, of course, and this serves to prevent the contact member from undesirably wobbling or chattering in the aperture 14. Another useful side effect of the invention is the wiping of the contacts 22, 26 during both opening and closing, which implements a self-cleaning action.

What is claimed is:

1. An electromagnetic contactor, comprising:

(a) a contactor body having a base (10);

(b) a crossbar (12) slidably mounted on said base and having a plurality of elongate apertures (14) therein defining guide surfaces;

(c) a plurality of movable contact members (16) individually slidably supported in said apertures on said guide surfaces, having movable contacts (22) mounted thereon, and being biased towards an end of said apertures; and (d) a plurality of fixed contacts (26) disposed in confronting relation to said movable contacts, respectively;

(e) said movable and fixed contacts jointly constituting normally open and normally closed contact pairs so that electrical circuits controlled by the contactor can be opened and closed in response to the sliding movement of said crossbar; and (f) said guide surfaces (18', 18'') being linear and continuously inclined relative to the direction of movement of said crossbar throughout the lengths of the apertures to ensure that a movable contact member of a closed contact pair is always supported on inclined guide surfaces, to thereby haltingly wedge said crossbar against said base during the sliding movement of the crossbar with a closed contact pair fused together.

2. A contactor according to claim 1, wherein said base has a slide surface (10*a*) on which said crossbar is slidable, said guide surfaces being inclined in directions to cause movable contact members of closed contact pairs to move away from said slide surface of said base as said crossbar is moved in a direction to open said closed contact pairs.

3. A contactor according to claim 1, further comprising a plurality of springs (20) for individually biasing said movable contact members towards ends of said apertures.

4. A contactor according to claim 1, wherein the guide surfaces for normally open contact pairs are inclined in an opposite direction to the guide surfaces for normally closed contact pairs.

5. A contactor according to claim 2, wherein the guide surfaces for normally open contact pairs are inclined in an opposite direction to the guide surfaces for normally closed contact pairs.

6. An electromagnetic contactor including a contactor body having a base (10), a crossbar (12) slidably mounted on said base for back and forth movement in a first direction and having a plurality of elongate apertures (14) therein defining guide surfaces, a plurality of movable contact members (16) individually slidably supported in said apertures on said guide surfaces for back and forth movement in said first direction, having movable contacts (22) mounted thereon, and being biased towards an end of said apertures, and a plurality of fixed contacts (26) disposed in respective confronting relation to said movable contacts, said fixed and movable contacts jointly constituting normally open and normally closed contact pairs so that electrical circuits controlled by the contactor can be opened and closed in response to the sliding movement of the crossbar, characterized by:

means (18', 18'') for preventing the closure of any open contact pairs when the crossbar is moved in a direction to close said open contact pairs with a pair of closed contact pairs fused together, to thereby avoid the simultaneous closure of both normally open and normally closed contact pairs, wherein said preventing means comprises means for haltingly wedging said crossbar against said base during the sliding movement of the crossbar, and wherein said wedging means comprises the guide surfaces being linear and continuously inclined relative to the direction of movement of the crossbar throughout the lengths of the apertures to ensure that a movable contact member of a closed contact pair is always supported on inclined guide surfaces.

* * * * *